US010289054B2

(12) United States Patent
Koyanagi

(10) Patent No.: US 10,289,054 B2
(45) Date of Patent: May 14, 2019

(54) IMAGE FORMING APPARATUS AND SHEET PROCESSING APPARATUS

(71) Applicant: CANON KABUSHIKI KAISHA, Tokyo (JP)

(72) Inventor: Noriaki Koyanagi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 18 days.

(21) Appl. No.: 15/392,072

(22) Filed: Dec. 28, 2016

(65) Prior Publication Data

US 2017/0212463 A1 Jul. 27, 2017

(30) Foreign Application Priority Data

Jan. 22, 2016 (JP) ..... 2016-011039

(51) Int. Cl.
*G03G 15/00* (2006.01)

(52) U.S. Cl.
CPC ..... *G03G 15/6582* (2013.01); *G03G 15/6541* (2013.01); *G03G 2215/00818* (2013.01); *G03G 2215/00827* (2013.01); *G03G 2221/1696* (2013.01)

(58) Field of Classification Search
CPC ..... G03G 15/70; G03G 15/5012; G03G 15/6582; G03G 15/6541; G03G 2215/00818; G03G 2215/00827; G03G 2221/1696; B65H 85/00; B65H 5/26; B65H 7/06; B65H 2301/33312; B65H 2511/528; B65H 2513/43; B65H 2513/51; B65H 2801/27; B65H 29/125; B65H 43/04; B65H 2402/10; B65H 2403/942; B65H 2404/632
See application file for complete search history.

(56) References Cited

U.S. PATENT DOCUMENTS 5,172,162 A * 12/1992 Taneda ..... B65H 29/60 270/58.14
5,305,995 A 4/1994 Nakajima et al.
6,134,418 A * 10/2000 Kato ..... B65H 29/00 271/207
6,671,491 B1 12/2003 Yamanaka et al.
(Continued)

FOREIGN PATENT DOCUMENTS

JP 2001-072311 A 3/2001
JP 2001-281951 A 10/2001
(Continued)

*Primary Examiner* — David H Banh
(74) *Attorney, Agent, or Firm* — Venable LLP

(57) ABSTRACT

A second sheet discharge portion is provided above a first sheet discharge portion in an image forming apparatus. First and second sheet processing units process a sheet discharged from the first sheet discharge portion, and the second sheet processing unit is provided between the first sheet discharge portion and the first sheet processing unit. A first support portion is provided on the first sheet processing unit. A second support portion is disposed upstream of the first support portion in a sheet discharge direction of the second sheet discharge portion and on or above the second sheet processing unit and supports the sheet discharged from the second sheet discharge portion in collaboration with the first support portion.

21 Claims, 10 Drawing Sheets

(56) References Cited

U.S. PATENT DOCUMENTS

| | | | | |
|---|---|---|---|---|
| RE39,168 | E * | 7/2006 | Hirota | G03G 15/6538 399/405 |
| 7,107,006 | B1 * | 9/2006 | Sato | G03G 15/6538 399/407 |
| 8,960,672 | B2 * | 2/2015 | Takenaka | B65H 43/02 271/256 |
| 9,096,398 | B2 * | 8/2015 | Nakagaki | B65H 7/20 |
| 9,096,409 | B2 | 8/2015 | Koyanagi | |
| 2006/0051147 | A1 * | 3/2006 | Sato | G03G 15/6538 399/405 |
| 2009/0148210 | A1 * | 6/2009 | Takenaka | G03G 15/234 399/381 |
| 2012/0155943 | A1 * | 6/2012 | Taki | G03G 15/234 399/401 |
| 2014/0183811 | A1 * | 7/2014 | Takenaka | B65H 15/00 271/3.19 |
| 2016/0318728 | A1 * | 11/2016 | Kowase | B65H 29/60 |
| 2016/0318731 | A1 * | 11/2016 | Kowase | B65H 43/04 |

FOREIGN PATENT DOCUMENTS

| | | | |
|---|---|---|---|
| JP | 2010-085431 | A | 4/2010 |
| JP | 2014-106294 | A | 6/2014 |

* cited by examiner

IMAGE FORMING APPARATUS AND SHEET PROCESSING APPARATUS

BACKGROUND OF THE INVENTION

Field of the Invention

The present invention relates to a sheet processing apparatus configured to process a sheet and to an image forming apparatus including a sheet processing unit.

Description of the Related Art

Examples of conventional image forming apparatuses such as copiers and printers include an image forming apparatus configured to discharge a sheet on which an image has been formed to a discharge space through a sheet discharge port defined in a side wall of a body of the image forming apparatus constituting an inner wall surface of the discharge space.

Japanese Patent Laid-Open No. 2001-72311 discloses an image forming apparatus configured to be equipped with a staple unit mounted in the discharge space. In the case of performing a binding process on a bundle of sheets, this image forming apparatus discharges sheets on which images have been formed to the staple unit through the sheet discharge port defined in the body of the image forming apparatus to subject the sheets to the binding process, and then discharges the bound sheets onto a support tray provided on the bottom surface of the discharge space.

In addition, Japanese Patent Laid-Open No. 2014-106294 discloses a sheet finishing apparatus provided with a plurality of sheet discharge portions arranged in the top-to-bottom direction. In the case of processing sheets, this apparatus discharges the sheets to a staple unit through a lower-tier sheet discharge portion. In the case of not processing the sheets, the sheets are discharged onto an upper cover of the sheet finishing apparatus through an upper-tier sheet discharge portion.

SUMMARY OF THE INVENTION

An aspect of the present invention provides an image forming apparatus or a sheet processing apparatus that can be installed in a smaller space and produced at a lower cost while having a configuration in which a plurality of sheet processing units can be attached thereto.

According to an aspect of the present invention, an image forming apparatus includes an image forming portion configured to form an image on a sheet, a first sheet discharge portion configured to discharge the sheet on which the image has been formed by the image forming portion, a second sheet discharge portion provided above the first sheet discharge portion and configured to discharge the sheet on which the image has been formed by the image forming portion, a first sheet processing unit configured to process the sheet on which the image has been formed by the image forming portion, and a second sheet processing unit including a body separate from the first sheet processing unit and configured to be mounted between the first sheet discharge portion and the first sheet processing unit. The second sheet processing unit is configured to process the sheet discharged from the first sheet discharge portion and guide the sheet to the first sheet processing unit. The image forming apparatus further includes a first support portion provided on the first sheet processing unit and a second support portion disposed upstream of the first support portion in a sheet discharge direction of the second sheet discharge portion and on or above the second sheet processing unit. The second support portion is configured to support the sheet discharged from the second sheet discharge portion in collaboration with the first support portion.

According to another aspect of the present invention, an image forming apparatus includes an image forming portion configured to form an image on a sheet, a first sheet discharge portion configured to discharge the sheet on which the image has been formed by the image forming portion, a second sheet discharge portion provided above the first sheet discharge portion and configured to discharge the sheet on which the image has been formed by the image forming portion, a first sheet processing unit configured to process the sheet on which the image has been formed by the image forming portion, and a second sheet processing unit including a body separate from the first sheet processing unit and configured to be mounted between the first sheet discharge portion and the first sheet processing unit. The second sheet processing unit is configured to process the sheet discharged from the first sheet discharge portion and then guide the sheet to the first sheet processing unit. The image forming apparatus further includes a first support portion provided on the first sheet processing unit and a second support portion disposed upstream of the first support portion in a sheet discharge direction of the second sheet discharge portion and configured in a body with the second sheet processing unit. The second support portion is configured to support the sheet discharged from the second sheet discharge portion in collaboration with the first support portion.

According to still another aspect of the present invention, a sheet processing apparatus, which is configured to be mounted on an image forming apparatus and process a sheet on which an image has been formed by the image forming apparatus, the image forming apparatus being provided with an image forming unit configured to form the image on the sheet, a first sheet discharge portion configured to discharge the sheet on which the image has been formed by the image forming portion, and a second sheet discharge portion provided above the first sheet discharge portion and configured to discharge the sheet on which the image has been formed by the image forming unit. The sheet processing apparatus includes a receiving port configured to receive the sheet discharged from the first sheet discharge portion, a processing portion configured to process the sheet received by the receiving port, a discharge part which is provided on an opposite side to the receiving port and onto which the sheet processed by the processing portion is discharged, and a support portion provided above the receiving port and configured to support the sheet discharged from the second sheet discharge portion. The support portion is movable and is capable of being positioned at a position where a part of the support portion is located farther from the discharge part than the receiving port in a horizontal direction.

Further features of the present invention will become apparent from the following description of exemplary embodiments with reference to the attached drawings.

DESCRIPTION OF THE EMBODIMENTS

Exemplary embodiments of the present invention will be described in detail with reference to drawings.

First Embodiment

Figure 1:
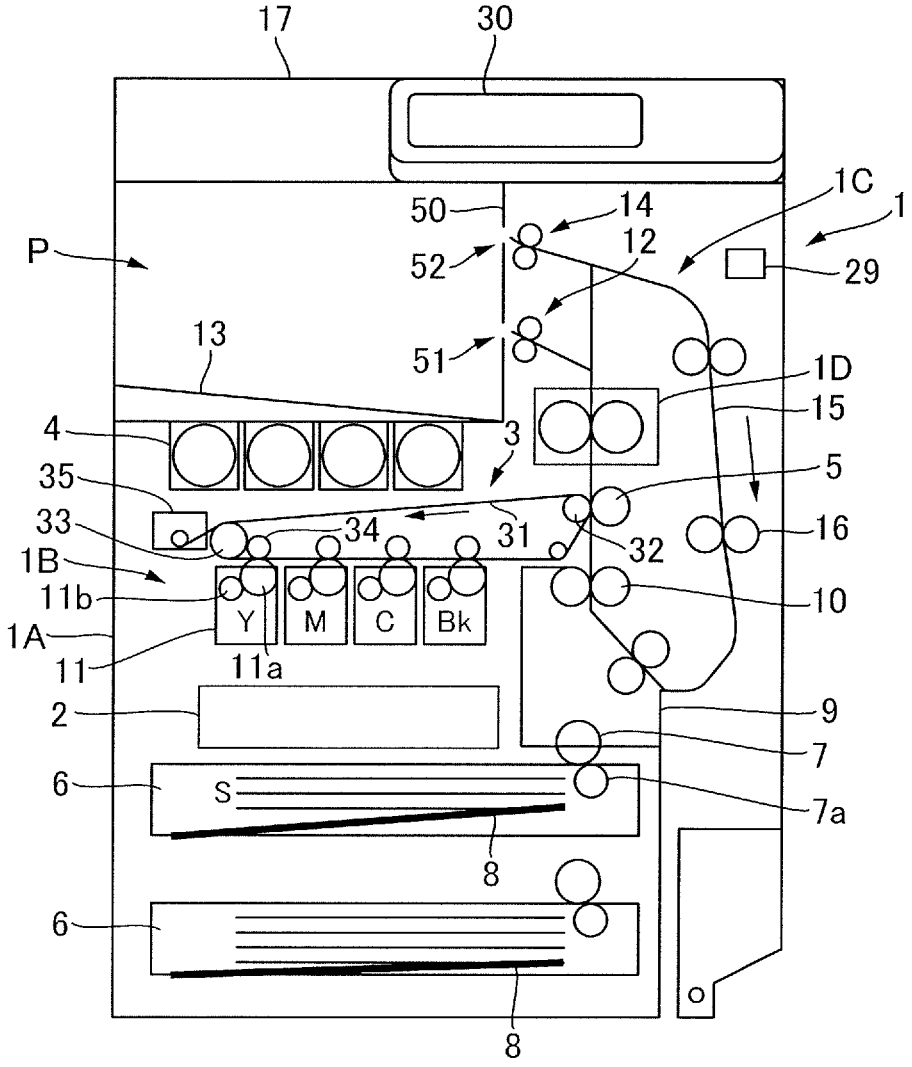
FIG. 1 illustrates a schematic configuration of a printer according to a first embodiment of the present disclosure.

FIG. 1 illustrates a schematic configuration of a full-color laser-beam printer serving as an example of an image forming apparatus according to a first embodiment. As illustrated in FIG. 1, an image reading unit 17 including an image reading portion 30 serving as an upper unit is provided on an upper surface of a printer body 1A serving as a body of a full-color laser-beam printer 1. The full-color laser-beam printer 1 will be hereinafter referred to as a printer 1. The image reading unit 17 is an example of a reading unit configured to read an image of a document, and is constituted by an optical system and a photoelectric conversion element. The optical system scans the document by irradiating the document with scanning light, and the photoelectric conversion element performs photoelectric conversion on light reflected by the document. An image forming section 1B serving as an image forming portion is provided in an upper portion of the printer body 1A, and sheet feeding cassettes 6 and pickup rollers 7 are provided in a lower portion of the printer body 1A. The sheet feeding cassettes 6 are sheet storing portions each storing a sheet S. The pickup rollers 7 each feed the sheet S from a corresponding sheet feeding cassette 6. In the printer body 1A, a discharge space P for discharging a sheet is provided between the image reading unit 17 and the image forming section 1B.

The image forming section 1B adopts a four-drum full-color system, and includes a laser scanner 2 and four process cartridges 11. The process cartridges 11 respectively form toner images of four colors of yellow, magenta, cyan, and black. Correspondence with yellow, magenta, cyan, and black may be hereinafter expressed with letters Y, M, C and K, respectively. The process cartridges 11 each include a photosensitive drum 11*a*, a developing unit 11*b*, an electrifier and a cleaner that are not illustrated, and so forth. The image forming section 1B further includes an intermediate transfer unit 3, toner cartridges 4, and so forth. The intermediate transfer unit 3 is disposed above the process cartridges 11, and the toner cartridges 4 are each provided for supplying toner to a corresponding developing unit 11*b*.

The intermediate transfer unit 3 includes an intermediate transfer belt 31, a driving roller 32, a tension roller 33, and primary transfer rollers 34. The intermediate transfer belt 31 is looped over the driving roller 32 and the tension roller 33. The primary transfer rollers 34 are provided in a space enclosed by the intermediate transfer belt 31 and each abut the intermediate transfer belt 31 at a position opposing a corresponding photosensitive drum 11*a*. The intermediate transfer belt 31 is rotated in an arrow direction in FIG. 1 by the driving roller 32 driven by a driving unit that is not illustrated.

At a position opposing the driving roller 32 in the intermediate transfer unit 3, a secondary transfer roller 5 is provided. The secondary transfer roller 5 transfers a color image formed on the intermediate transfer belt 31 onto the sheet S. A fixing unit 1D is further disposed above the secondary transfer roller 5, and a first discharge roller pair 12 and a second discharge roller pair 14 are disposed to the upper-left of the fixing unit 1D in FIG. 1. The second discharge roller pair is capable of rotating in a normal direction and in a reverse direction. Further, a sheet flipping section 1C is disposed above the fixing unit 1D. The sheet flipping section 1C is configured to convey a sheet on one surface of which an image has been formed to the image forming section 1B again. A re-conveyance path 15 is provided in the sheet flipping section 1C, and reverse conveyance rollers 16 are disposed in the re-conveyance path 15. Further, a control unit 29 is provided at a predetermined position of the printer body 1A. The control unit 29 is configured to control an image forming operation of the image forming section 1B, a sheet feeding operation, and sheet processing operations performed by a staple unit 18 and a punch unit 22 that will be described later and that each serve as a sheet processing unit.

The image forming operation of the printer 1 will be described next. First, the image reading unit 17 reads image information of the document. Then, the image information is subjected to image processing, converted into an electric signal, and transmitted to the laser scanner 2 of the image forming section 1B. Image information transmitted from an external apparatus such as a personal computer is also converted into an electric signal and transmitted to the laser scanner 2. As a result of this, the laser scanner 2 emits laser light to sequentially expose the surfaces of respective photosensitive drums 11*a* of the process cartridges 11, and electrostatic latent images respectively corresponding to yellow, magenta, cyan, and black are sequentially formed on respective photosensitive drums 11*a*.

After this, the electrostatic latent images are visualized by being developed with toners of respective colors, and the toner images of respective colors on the photosensitive drums 11*a* are sequentially transferred, by a primary transfer bias applied to the primary transfer rollers 34, onto the intermediate transfer belt 31 so as to be superimposed on one another. As a result of this, a toner image is formed on the intermediate transfer belt 31. The toner image formed on the intermediate transfer belt 31 through primary transfer is again transferred onto a sheet at the secondary transfer roller 5. Toner that has not been transferred at the secondary transfer roller 5 and is remaining on the intermediate transfer belt 31 is collected by a cleaner 35.

In parallel with this operation of forming a toner image, a sheet S stored in one of the sheet feeding cassettes 6 and lifted up by a lifter plate 8 to a position at which the sheet S can be fed by the pickup roller 7 is delivered out by the pickup roller 7. The sheet S that has been delivered out is conveyed to a conveyance path 9, and the skew thereof is then corrected by a registration roller pair 10. In the case where a plurality of sheets S are fed at the same time, a single sheet S is separated from the sheets S by a separation section constituted by the pickup roller 7 and a separation roller 7*a*.

The sheet S, the skew of which has been corrected, is conveyed to a secondary transfer portion by the registration roller pair 10, and, at the secondary transfer portion, the toner images transferred onto the intermediate transfer belt 31 are collectively transferred onto the sheet S as a result of a secondary transfer bias applied to the secondary transfer roller 5. Subsequently, the sheet S onto which the toner images have been transferred is conveyed to the fixing unit 1D. The fixing unit 1D applies heat and pressure to the sheet S to melt and mix the toners of respective colors, and the toners are fixed to the sheet S as a color image.

The sheet S to which the image has been fixed is discharged to the discharge space P through a first discharge port 51 by the first discharge roller pair 12 serving as a first sheet discharge portion. The first discharge port 51 is defined in a lower portion of an inner wall surface 50, which is a wall surface defining the discharge space P of the printer body 1A on the upstream side in a sheet discharge direction. The sheet S is then supported on a support portion 13 provided on the bottom surface of the discharge space P. After a predetermined number of sheets are discharged, the sheet S to which an image has been fixed is discharged to the discharge space P through a second discharge port 52 by the second discharge roller pair 14 serving as a second sheet discharge portion. The second discharge port 52 is defined in an upper portion of the inner wall surface 50, and the second discharge roller pair 14 is disposed above the first discharge roller pair 12.

In the case of forming images on both surfaces of the sheet S, the sheet S is conveyed to the re-conveyance path 15 by reverse rotation of the second discharge roller pair 14 after the image is fixed to the sheet S, and is then conveyed to the conveyance path 9 again by the reverse conveyance rollers 16 and to the image forming section 1B thereafter. Then, after images are formed on both surfaces of the sheet S, the sheet S is discharged to the discharge space P by the first discharge roller pair 12 or the second discharge roller pair 14.

Figure 2:
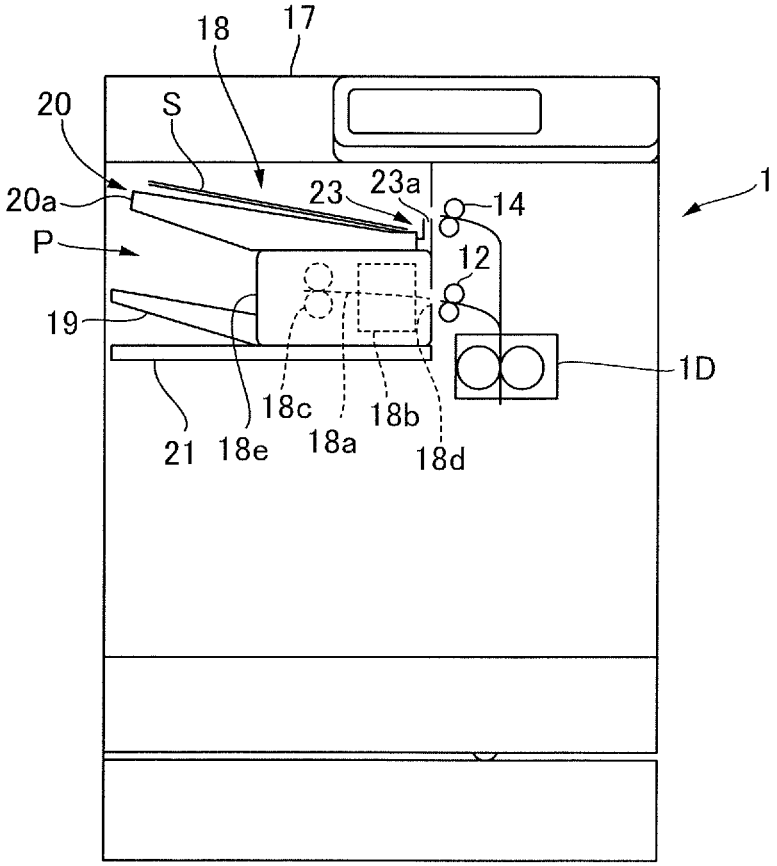
FIG. 2 illustrates a state in which a staple unit is mounted in a discharge space provided in the printer.

In the present exemplary embodiment, as illustrated in FIG. 2, the staple unit 18 serving as a first sheet processing unit that is an exemplary sheet processing apparatus can be mounted in the discharge space P. The staple unit 18 is configured to perform a staple process on sheets discharged by the first discharge roller pair 12. The staple unit 18 includes a discharged sheet conveyance path 18*a*, a staple processing portion 18*b*, and discharge rollers 18*c*. The sheets discharged by the first discharge roller pair 12 passes through the discharged sheet conveyance path 18*a*. The staple processing portion 18*b* serves as a processing portion and is disposed along the discharged sheet conveyance path 18*a*. The discharge rollers 18*c* discharge a bundle of stapled sheets. In a body 18*e* of the staple unit 18, a receiving port 18*d* is defined. The receiving port 18*d* communicates with the discharged sheet conveyance path 18*a*, and sheets discharged from the first discharge roller pair 12 or the punch unit 22, which will be described later, are received through the receiving port 18*d*.

The staple unit 18 also includes a lower sheet discharge tray 19. The lower sheet discharge tray 19 is disposed on an opposite side to the receiving port 18*d* in a horizontal direction and serves as a discharge part configured to support the bundle of stapled sheets discharged by the discharge rollers 18*c*. Further, an upper sheet discharge tray 20 serving as a sheet support portion is provided on the staple unit 18. The upper sheet discharge tray 20 allows the second discharge roller pair 14 to discharge a sheet to the discharge space P even in the case where the staple unit 18 is disposed in the discharge space P.

The upper sheet discharge tray 20 includes a tray body 20*a* and a drawing-out member 23. The tray body 20*a* serves as a body of a sheet support portion configured to support a sheet. The drawing-out member 23 serves as a sheet support portion provided in the tray body 20*a* so as to be capable of being drawn out in a direction opposite to the sheet discharge direction. In other words, the tray body 20*a* and the drawing-out member 23 are one example of a first support portion and a second support portion that collaboratively support a sheet discharged by the second discharge roller pair 14. The upper sheet discharge tray 20 is inclined such that a more downstream portion thereof in the sheet discharge direction is higher than a more upstream portion thereof in the sheet discharge direction. Therefore, a trailing end regulating portion 23*a* standing upright is provided on an upstream end of the drawing-out member 23 in the sheet discharge direction. The trailing end regulating portion 23*a* enables regulating the position of the trailing end of a sheet, which is an upstream end of the sheet in the sheet discharge direction, even in the case where the sheet is discharged onto the upper sheet discharge tray 20, which is inclined.

Figure 3A:
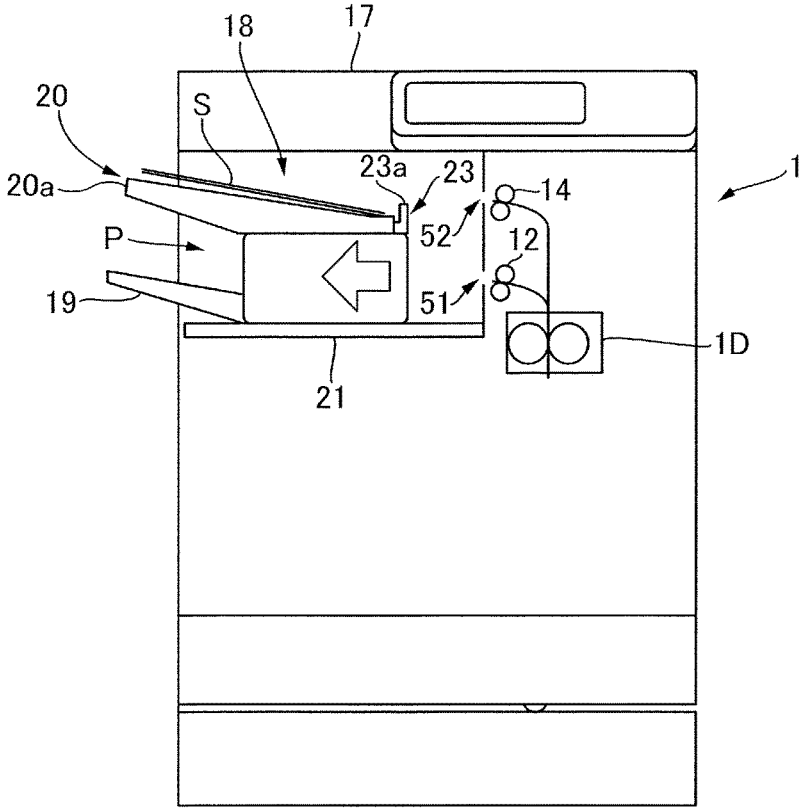
FIG. 3A illustrates a state in which the staple unit mounted in the discharge space of the printer is moved.

The staple unit 18 is movable parallel to the sheet discharge direction with respect to the printer body 1A. The support portion 13 is provided with a slide rail 21 serving as a hold portion configured to movably hold the staple unit 18. In the case of removing a jam or doing maintenance, the staple unit 18 is moved downstream in the sheet discharge direction along the slide rail 21 as illustrated in FIG. 3A.

Figure 3B:
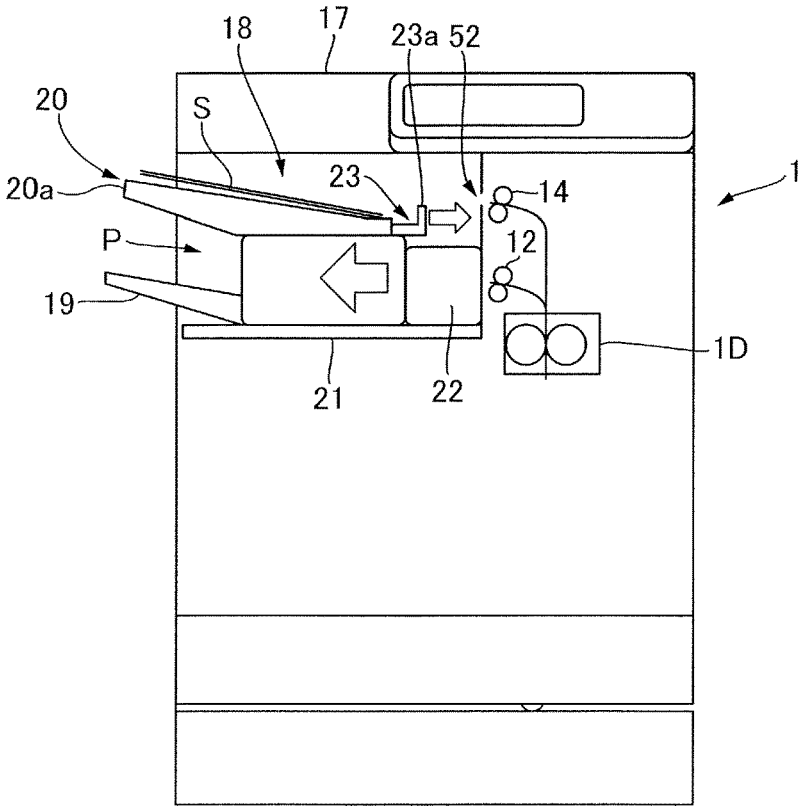
FIG. 3B illustrates a state in which a punch unit is disposed in the discharge space.
Figure 6A:
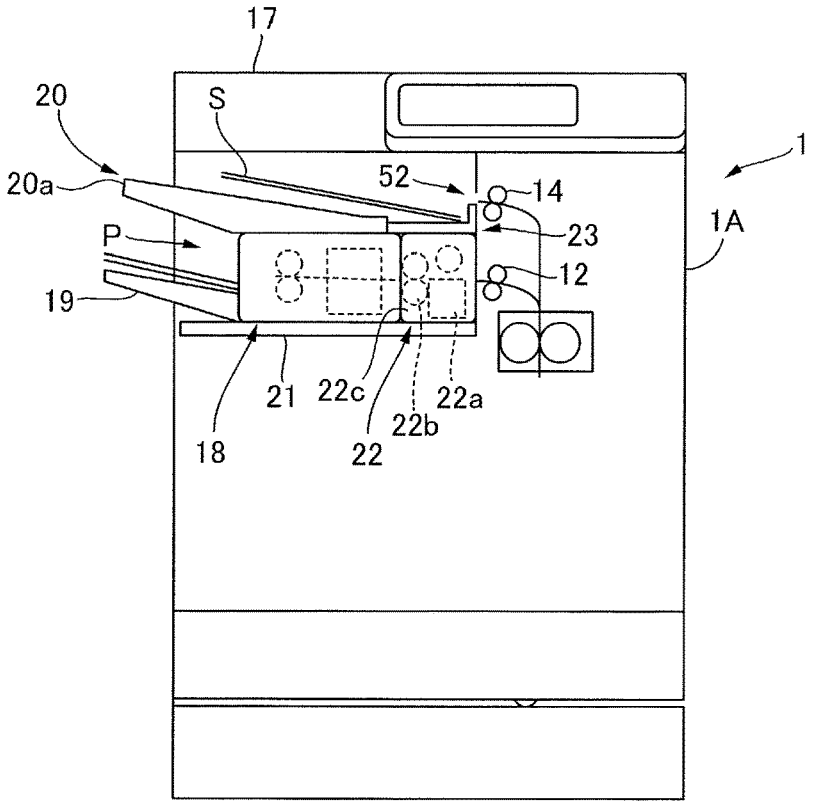
FIG. 6A illustrates a state in which a drawing-out member provided in an upper sheet discharge tray of the staple unit is drawn out.

In the present exemplary embodiment, a punched hole can be bored in a sheet on which an image has been formed, or sheets with punched holes can be bound, for example. In such a case of boring a punched hole in a sheet, the punch unit 22 is additionally disposed between the staple unit 18 and the printer body 1A as illustrated in FIG. 3B. The punch unit 22 serves as a second sheet processing unit configured to perform a punch process. The punch unit 22 is composed of a body 22*c* separate from the staple unit 18, and provided with a punching portion 22*a*, sheet discharge rollers 22*b*, and so forth, as illustrated in FIG. 6A. The sheet discharge rollers 22*b* discharge a sheet in which a punched hole has been bored. In the case of boring a punched hole in a sheet, the sheet is discharged from the first discharge roller pair 12 to the punch unit 22, a punched hole is formed in the sheet by the punching portion 22*a*, and then the sheet is conveyed to the staple unit 18 by the sheet discharge rollers 22*b*. In the case of binding the sheet, the sheet is then subjected to a binding process in the staple unit 18.

That is, the staple unit 18 can be mounted at a first mount position illustrated in FIG. 6A and at a second mount position illustrated in FIG. 2. At the first mount position, the staple unit 18 receives the sheet discharged by the first discharge roller pair 12 via the punch unit 22. At the second mount position, the staple unit 18 receives the sheet discharged by the first discharge roller pair 12 in a state where the punch unit 22 is not mounted.

The staple unit 18 is an example of a first sheet processing unit, and the first sheet processing unit is not limited to a unit that performs a staple process. For example, a processing unit that performs a folding process may be employed as the first sheet processing unit. In addition, the punch unit 22 is an example of a second sheet processing unit that can be additionally used with the first sheet processing unit, and the second sheet processing unit is not limited to a unit that performs a punch process. For example, a reversing unit that reverses a sheet may be employed as the second sheet processing unit.

Figure 4:
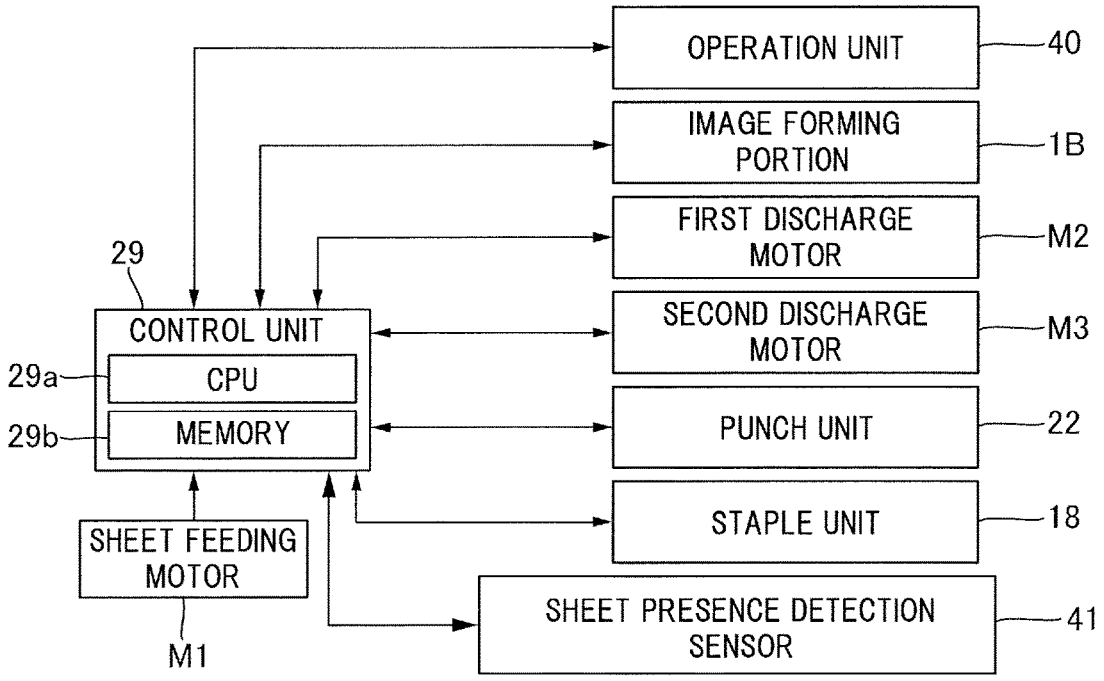
FIG. 4 is a control block diagram of the printer.

FIG. 4 is a control block diagram of the printer 1. The control unit 29 includes a CPU 29*a* and a memory 29*b*. The memory 29*b* stores a program. The control unit 29 is connected to the image forming section 1B described above, a sheet feeding motor M1, a first discharge motor M2, and a second discharge motor M3. The sheet feeding motor M1 drives the pickup rollers 7, the first discharge motor M2 drives the first discharge roller pair 12, and the second discharge motor M3 drives the second discharge roller pair 14. The control unit 29 is also connected to a sheet presence detection sensor 41, the staple unit 18, the punch unit 22, and so forth. The sheet presence detection sensor 41 detects the presence of a sheet in the sheet feeding cassettes 6.

The control unit 29 controls, on the basis of the program stored in the memory 29*b* and in accordance with settings input via an operation unit 40, an image forming operation by the image forming section 1B, driving by the motors M1 to M3, a binding operation by the staple unit 18, and a punching operation by the punch unit 22. In the present exemplary embodiment, in the case where a staple mode in which the staple process is performed or a punch mode in which the punch process is performed is selected, the control unit 29 selects a tray onto which a sheet is to be discharged in accordance with the selected mode.

Figure 5:
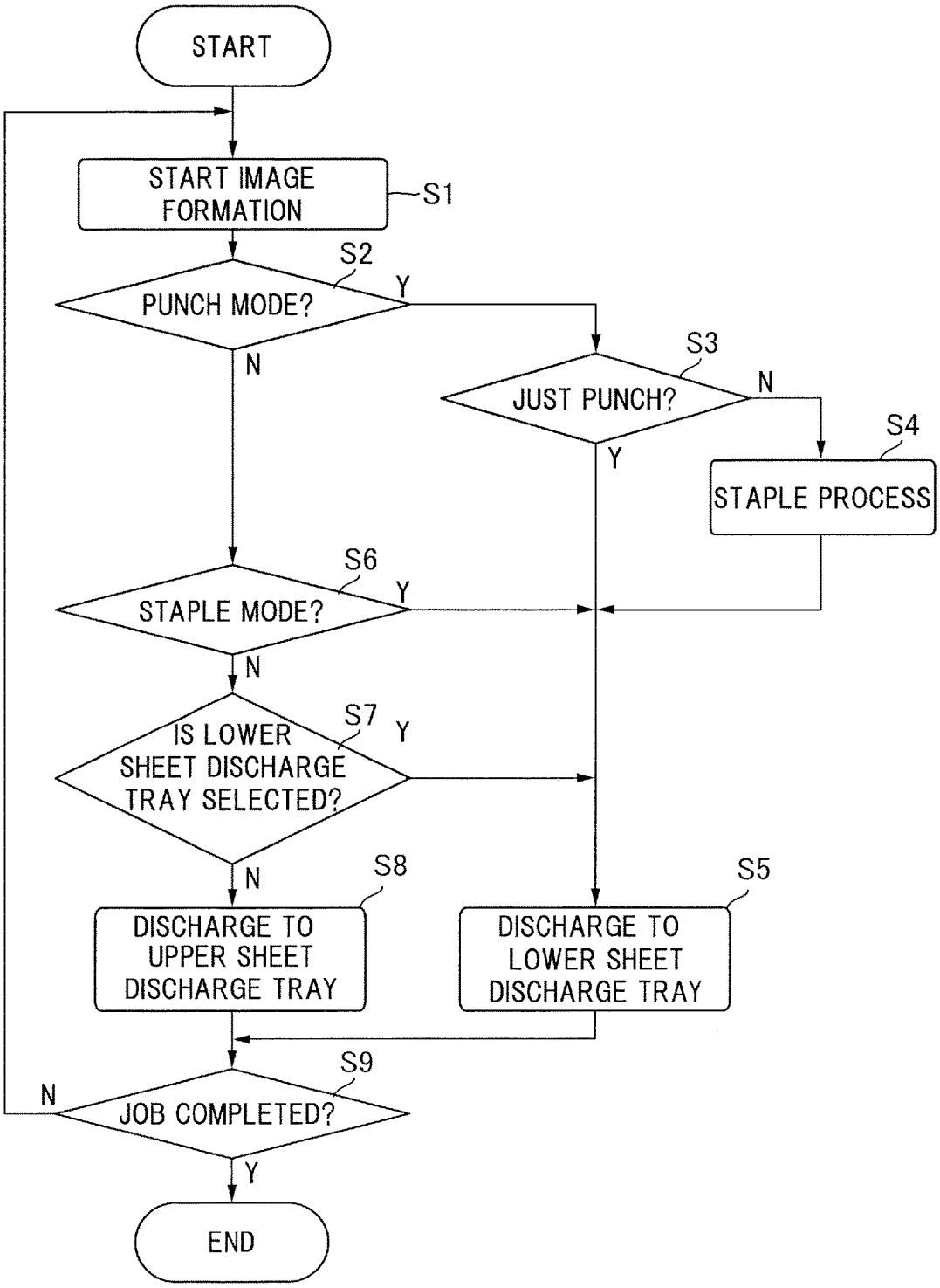
FIG. 5 is a flowchart illustrating a control operation by a control unit of the printer.

The control operation by the control unit 29 corresponding to the selected mode will be described next with reference to a flowchart illustrated in FIG. 5. After an instruction to form an image on a sheet and to process the sheet is transmitted from the operation unit 40 or from a computer, the control unit 29 first determines whether a sheet is present in a corresponding sheet feeding cassette 6 on the basis of a signal from the sheet presence detection sensor 41, and, in the case where it is determined that a sheet is present, starts an image forming operation in step S1. The control unit 29 also drives the sheet feeding motor M1 to feed a sheet by the pickup roller 7.

Then, after the toner images of respective colors on the photosensitive drums 11*a* are transferred onto the sheet and the transferred toner images are fixed to the sheet by the fixing unit 1D, the control unit 29 determines whether the punch mode is set as a processing mode in step S2. In the case where the punch mode is set, that is, where the result of step S2 is Y, the control unit 29 determines discharging the sheet onto the lower sheet discharge tray 19. After this, the first discharge roller pair 12 discharges the sheet to the punch unit 22 through the first discharge port 51.

In addition, in the case where the punch mode is set, that is, where the result of step S2 is Y, the control unit 29 determines whether only the punch process is set in step S3. In the case where only the punch process is set, that is, where the result of step S3 is Y, the sheet passes through the staple unit 18 without being subjected to the staple process, and is then discharged onto the lower sheet discharge tray 19 in step S5. In the case where the staple process is set in addition to the punch process, that is, where the result of step S3 is N, the sheet is subjected to the staple process in step S4, and then is discharged onto the lower sheet discharge tray 19 in step S5.

In the case where the punch mode is not set, that is, where the result of step S2 is N, the control unit 29 subsequently determines whether the staple mode is set in step S6. In the case where the staple mode is set, that is, where the result of step S6 is Y, the control unit 29 determines discharging the sheet onto the lower sheet discharge tray 19. In this case, the sheet is discharged to the punch unit 22, passes through the punch unit 22 without being subjected to the punch process, and then subjected to the staple process. After this, the sheet is discharged onto the lower sheet discharge tray 19 in step S5.

In the case where the punch mode is not set and the staple process is not set either, that is, where the results of steps S2 and S6 are both N, the control unit 29 determines whether the sheet is to be discharged onto the lower sheet discharge tray 19 in step S7. In the case where the sheet is to be discharged onto the lower sheet discharge tray 19, that is, where the result of step S7 is Y, the sheet passes through the punch unit 22 and the staple unit 18 without being subjected to the punch process or the staple process, and then is discharged onto the lower sheet discharge tray 19 in step S5.

In the case where the sheet is not to be discharged onto the lower sheet discharge tray 19 because of the sheet loading state of the lower sheet discharge tray 19, that is, where the result of step S7 is N, the sheet is discharged onto the upper sheet discharge tray 20 in step S8. Then, in step S9, the control unit 29 determines whether a job is completed. In the case whether the job is not completed, that is, where the result of step S9 is N, this control operation is continued. In the case where the job is completed, that is, where the result of step S9 is Y, the image forming operation is finished.

In the case where a punch unit is to be additionally disposed, the staple unit 18 is moved downstream in the sheet discharge direction as illustrated in FIG. 3A that has been already mentioned, and thus a space for mounting the punch unit 22 therein is provided between the staple unit 18 and the first discharge roller pair 12. Then, the punch unit 22, which is attachable to and detachable from the printer body 1A, is mounted in this space as illustrated in FIG. 3B.

In the present exemplary embodiment, after the staple unit 18 is moved and the punch unit 22 is mounted, the drawing-out member 23 is drawn out in an opposite direction to the sheet discharge direction so as to abut a portion of the inner wall surface 50 of the printer body 1A below the second discharge port 52. In the case where the drawing-out member 23 is drawn out in this way, the drawing-out member 23 is positioned above the punch unit 22. This allows the sheet S discharged by the second discharge roller pair 14 to be supported by the upper sheet discharge tray 20 above the punch unit 22 as illustrated in FIG. 6A.

Figure 6B:
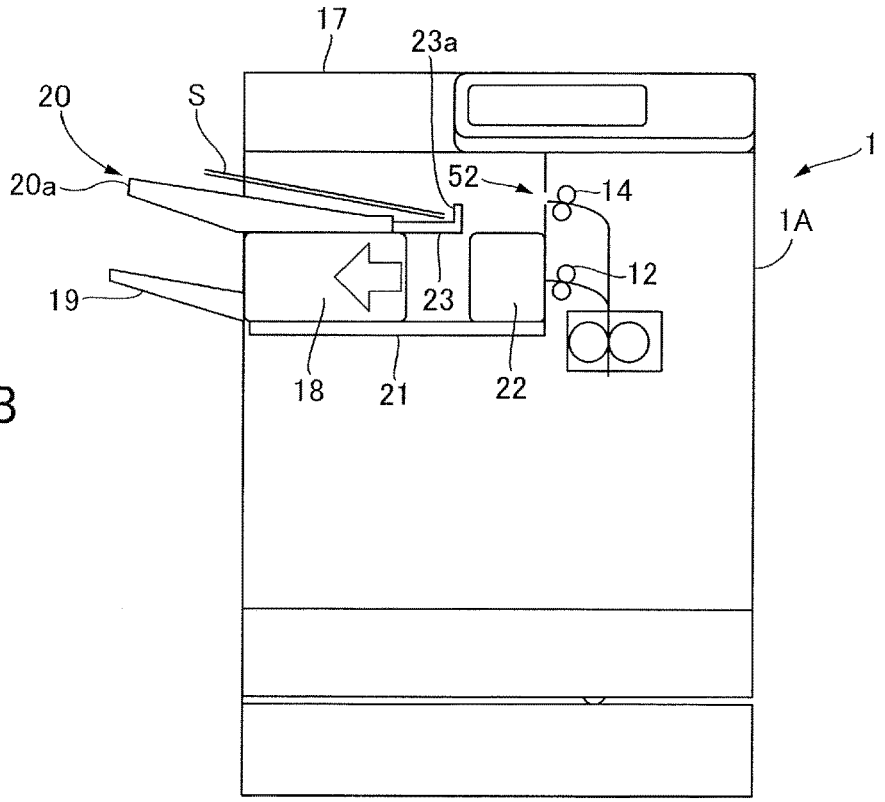
FIG. 6B illustrates a state in which the staple unit is moved with the drawing-out member having been drawn out.

In the case where, for example, a jam has occurred between the staple unit 18 and the punch unit 22, the staple unit 18 is moved downstream in the sheet discharge direction as illustrated in FIG. 6B to remove the jam. Since the drawing-out member 23 is provided with the trailing end regulating portion 23*a*, the sheet supported on the upper sheet discharge tray 20 does not fall down even in the case where the staple unit 18 is moved in this way.

As has been described above, a second sheet processing unit different from the staple unit 18 serving as a first sheet processing unit is additionally disposed in the discharge space. That is, the staple unit 18 is moved downstream in the sheet discharge direction, and the punch unit 22 is disposed between the staple unit 18 and the first discharge roller pair 12. Conventionally, it has been difficult to smoothly convey the sheet from the second discharge roller pair 14 onto the upper sheet discharge tray 20 of the staple unit 18 in the case where the punch unit 22 is mounted between the staple unit 18 and the first discharge roller pair 12 in this way. In other words, in the configuration in which a support portion that supports a sheet discharged from a second sheet discharge portion is provided on a sheet processing unit, how to treat the sheet discharged from the second sheet discharge portion has been a problem in the case where another sheet processing unit is added.

Concerning this problem, a configuration in which a relay path is provided on the punch unit 22 and the sheet discharged from an upper sheet discharge portion is supported on an upper tray after being conveyed via the relay path can be considered as a comparative configuration. However, if the relay path is provided on the punch unit 22, the punch unit 22 will be larger and more parts thereof will be required because conveyance rollers for conveying the sheet will need to be provided in the relay path. This will lead to an increase in the costs.

By contrast, in the present exemplary embodiment, the drawing-out member 23, which is capable of being drawn out in the opposite direction to the sheet discharge direction, is provided in the upper sheet discharge tray 20. In the case where the punch unit 22 is additionally disposed, the sheet discharged by the second discharge roller pair 14 can be supported on the upper sheet discharge tray 20 above the punch unit 22 by drawing out the drawing-out member 23 over the punch unit 22. This enables cutting the space and costs for the punch unit 22 additionally disposed in the discharge space P because, according to this configuration, the relay path or the like does not need to be provided on the punch unit 22 even in the case where the punch unit 22 is to be additionally disposed.

The drawing-out member 23 is an example of a member that projects upstream of a first support portion in the sheet discharge direction and is movable between a first position, which is a position on or above the second sheet processing unit, and a second position, which is a position downstream of the first position in the sheet discharge direction, and another moving mechanism may be employed. For example, a movable member that is pivotable, with an upstream portion of the upper sheet discharge tray 20 serving as a pivot shaft, between a position at which the movable member projects upstream of the upper sheet discharge tray 20 in the sheet discharge direction and a position at which the movable member is housed in the upper sheet discharge tray 20 may be provided. The drawing-out member 23 also may be in a shape inclined such that a more downstream portion thereof in the sheet discharge direction is higher.

Second Embodiment

Figure 7:
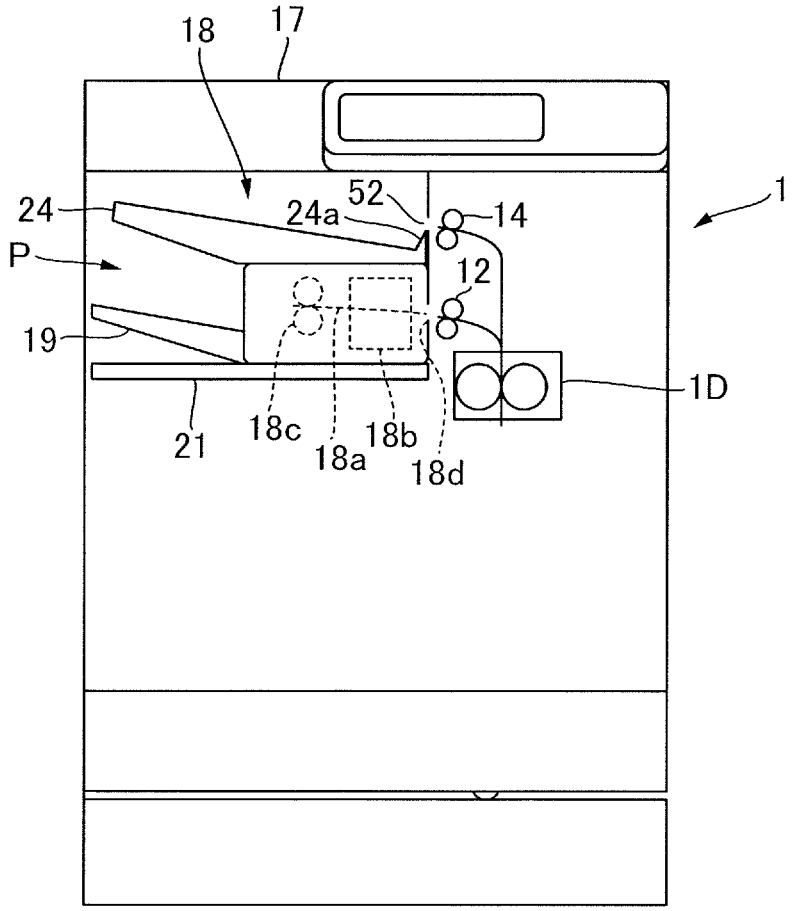
FIG. 7 illustrates a state in which a staple unit is mounted in a discharge space provided in a printer according to a second embodiment of the present disclosure.

A second embodiment will be described next. FIG. 7 illustrates a state in which a staple unit is mounted in a discharge space provided in an image forming apparatus according to the present exemplary embodiment. In FIG. 7, the same reference numerals as in FIGS. 1 and 2 indicate the same elements or the equivalents thereof.

As illustrated in FIG. 7, an upper sheet discharge tray 24 is provided on the staple unit 18. The upper sheet discharge tray 24 serves as a support portion that is inclined such that a more downstream portion thereof in the sheet discharge direction is higher than a more upstream portion thereof in the sheet discharge direction. A trailing end regulating portion 24*a* standing upright is provided on an upstream end of the upper sheet discharge tray 24 in the sheet discharge direction. The trailing end regulating portion 24*a* enables regulating the position of the trailing end of a sheet even in the case where the sheet is discharged onto the upper sheet discharge tray 24, which is inclined. In addition, the upper sheet discharge tray 24 is held on the staple unit 18 so as to be movable parallel to the sheet discharge direction by a slide mechanism that is not illustrated.

Figure 8A:
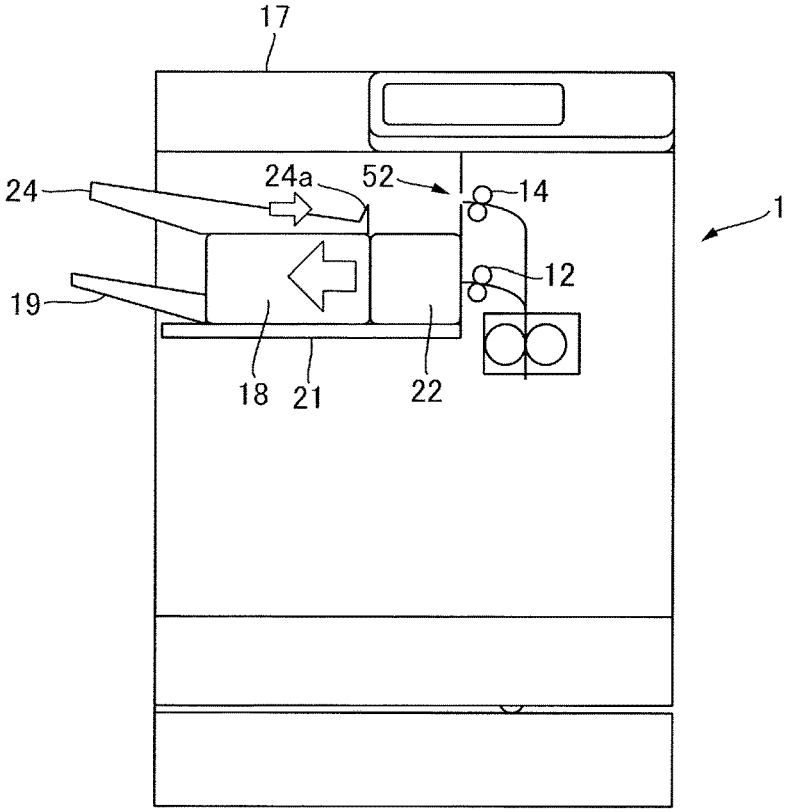
FIG. 8A illustrates a state in which an upper sheet discharge tray of the staple unit according to the second embodiment is drawn out.

Also in the present exemplary embodiment, a punched hole can be bored in a sheet on which an image has been formed, or sheets with punched holes can be bound. In such a case of boring a punched hole in a sheet, the staple unit 18 is moved downstream in the sheet discharge direction, and then the punch unit 22 is mounted as illustrated in FIG. 8A. In the case of boring a punched hole in a sheet, the sheet is discharged from the first discharge roller pair 12 to the punch unit 22, and a punched hole is bored in the sheet. Then, in the case of binding sheets, the sheet is subjected to the binding process in the staple unit 18.

Figure 8B:
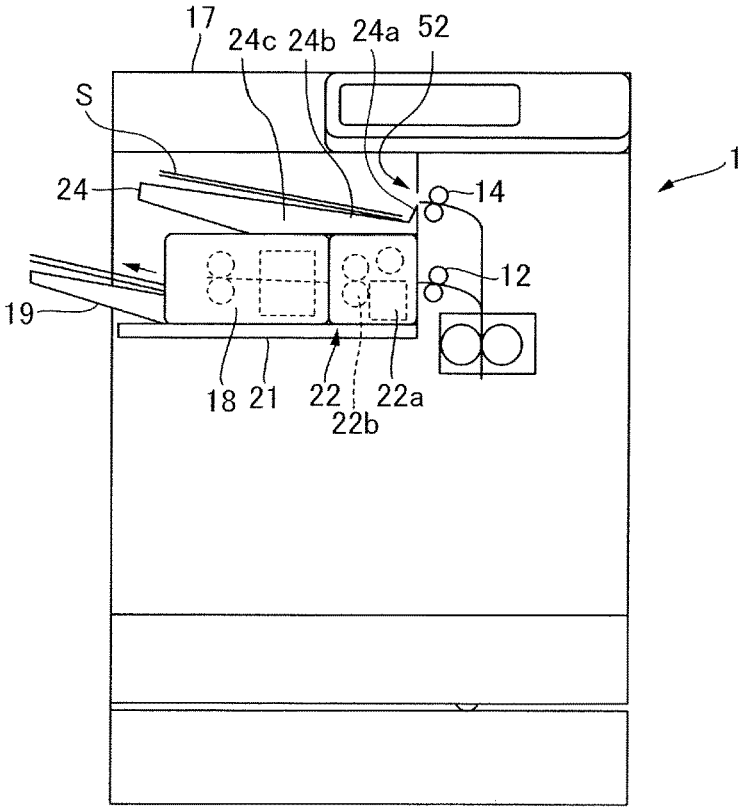
FIG. 8B illustrates a state in which a punch unit is provided in the discharge space.

In addition, in the case of mounting the punch unit 22, the upper sheet discharge tray 24 of the staple unit 18 is drawn out in an opposite direction to the sheet discharge direction so as to move to a position below the second discharge port 52 provided in the printer body 1A as illustrated in FIG. 8B. As a result of this, an upstream portion of the upper sheet discharge tray 24 in the sheet discharge direction is positioned on the punch unit 22, and thus the sheet discharged by the second discharge roller pair 14 can be supported on the upper sheet discharge tray 24. In other words, in the upper sheet discharge tray 24, a downstream portion 24*c* in the sheet discharge direction corresponds to a first support portion, and an upstream portion 24*b* corresponds to a second support portion configured to form, in collaboration with the first support portion, a support surface that supports the sheet. The first support portion and the second support portion according to the present exemplary embodiment are capable of integrally slide with respect to the staple unit 18.

Figure 9:
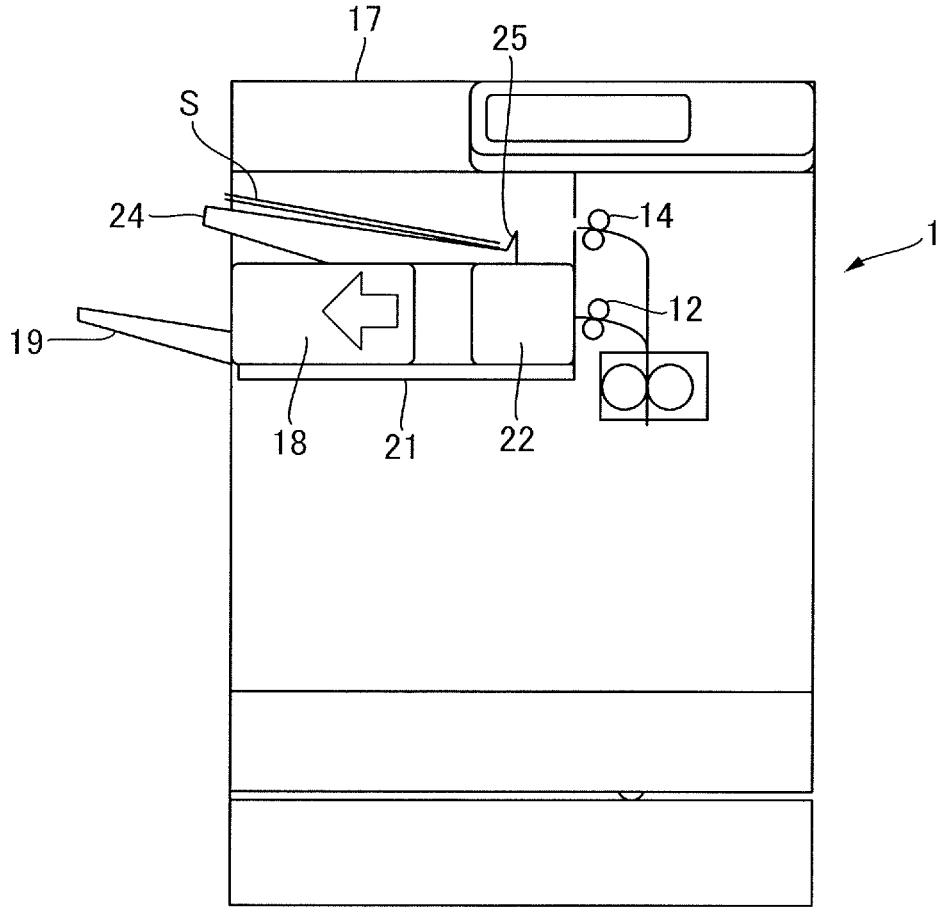
FIG. 9 illustrates a state in which the staple unit according to the second embodiment is moved with the upper sheet discharge tray having been drawn out.

In the case where, for example, a jam has occurred between the staple unit 18 and the punch unit 22, the staple unit 18 is moved downstream in the sheet discharge direction as illustrated in FIG. 9 to remove the jam. Since the upper sheet discharge tray 24 is provided with the trailing end regulating portion 24*a*, the sheet supported on the upper sheet discharge tray 20 does not fall down even in the case where the staple unit 18 is moved.

As has been described above, in the present exemplary embodiment, the upper sheet discharge tray 24 is provided on the staple unit 18 so as to be capable of being drawn out. In the case where the punch unit 22 is additionally disposed, the sheet discharged by the second discharge roller pair 14 can be supported on the upper sheet discharge tray 24 on the punch unit 22 by drawing out the upper sheet discharge tray 24 on the punch unit 22. This enables cutting the space and costs for the punch unit 22 additionally disposed in the discharge space P because, according to this configuration, the relay path or the like does not need to be provided on the punch unit 22 even in the case where the punch unit 22 is to be additionally disposed.

In addition, in the present exemplary embodiment, the upstream portion 24*b* and the downstream portion 24*c* of the upper sheet discharge tray 24 are integrally formed, and forms a continuous support surface that supports the sheet discharged by the second discharge roller pair 14 as illustrated in FIG. 8B. That is, the height of a downstream end of the upstream portion 24*b* serving as the first support portion in the sheet discharge direction and the height of an upstream end of the downstream portion 24*c* serving as the second support portion match. This reduces the likelihood of a leading end of the sheet getting caught in the boundary between the first support portion and the second support portion, and thus the sheet is stably supported.

Other Embodiments

In the first embodiment that has been already described, an embodiment in which a sheet to be supported is received above the punch unit 22 by the drawing-out member 23 movably provided on the staple unit 18 has been described as an example. In the second embodiment that has been already described, an embodiment in which a sheet to be supported is received above the punch unit 22 by the upper sheet discharge tray 24 movably provided on the staple unit 18 has been described as an example.

Figure 10A:
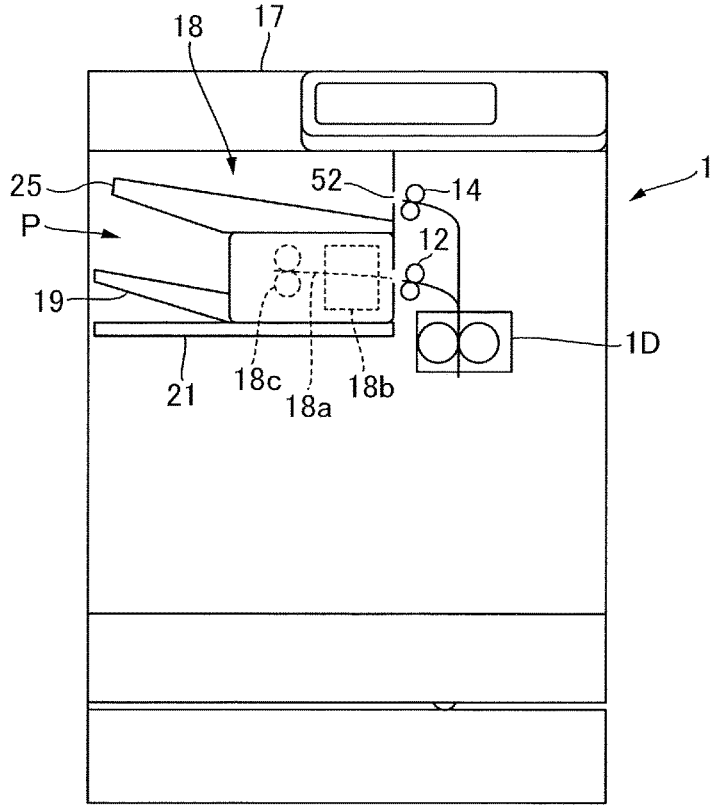
FIG. 10A illustrates a state in which a punch unit is not mounted in a discharge space of an image forming apparatus according to a modification embodiment of the present disclosure.
Figure 10B:
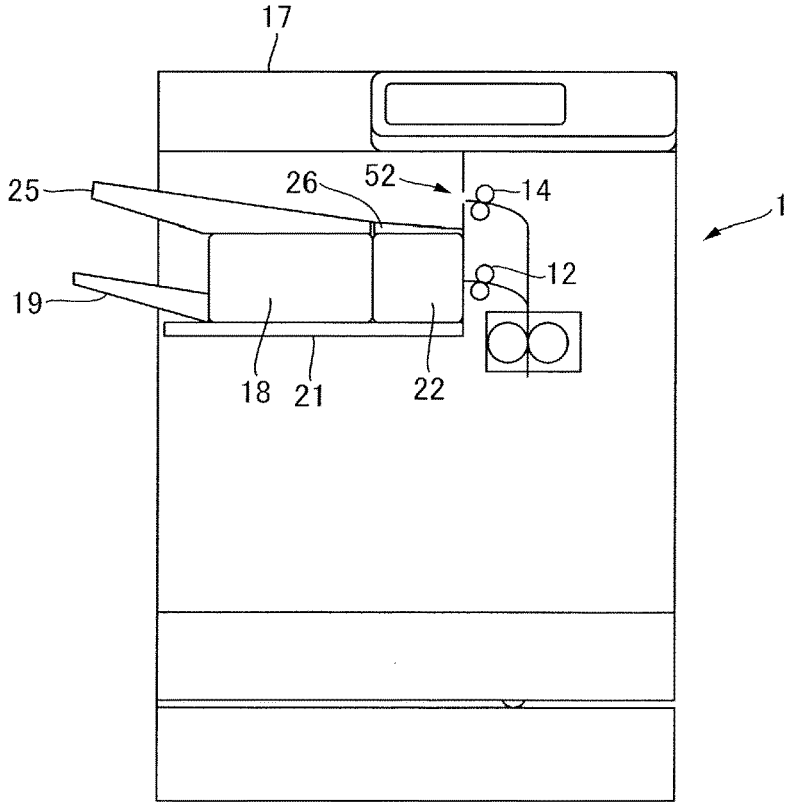
FIG. 10B illustrates a state in which the punch unit is mounted in the discharge space according to the modification embodiment.

However, the present technique is not limited to these embodiments, and a support portion 26 serving as the second support portion configured to support a sheet may be provided on the punch unit 22 as in a modification embodiment illustrated in FIGS. 10A and 10B. In this case, it is preferred that an upper sheet discharge tray 25 serving as the first support portion is fixed to the staple unit 18. FIG. 10A illustrates a state in which the punch unit 22 is not mounted. FIG. 10B illustrates a state in which the punch unit 22 is mounted. In the case where the punch unit 22 is disposed as illustrated in FIG. 10B, the sheet is laid over both of the support portion 26 of the punch unit 22 and the upper sheet discharge tray 25 of the staple unit 18. In this case, it is preferred that the height of an upstream end of the upper sheet discharge tray 25 in the sheet discharge direction and the height of a downstream end of the support portion 26 match. According to this configuration, the likelihood of a leading end of the sheet getting caught in the boundary between upper sheet discharge tray 25 and the support portion 26 is reduced, and thus the sheet is stably supported.

Embodiments in which the staple unit 18 is movably held in the discharge space by the slide rail 21 have been described as examples. However, the staple unit does not need to be slidably held. That is, a configuration in which the staple unit 18 can be mounted in two positions of a position near the second discharge roller pair 14, which is for the case where the punch unit 22 is not to be mounted, and a position far from the second discharge roller pair 14, which is for the case where the punch unit 22 is mounted, may be employed.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-011039, filed on Jan. 22, 2016, which is hereby incorporated by reference herein in its entirety.

What is claimed is:

1. An image forming apparatus comprising:

an apparatus body;

an image forming portion disposed in the apparatus body and configured to form an image on a sheet;

a first sheet discharge portion configured to discharge the sheet, on which the image has been formed by the image forming portion, out of the apparatus body;

a second sheet discharge portion provided above the first sheet discharge portion and configured to discharge the sheet, on which the image has been formed by the image forming portion, out of the apparatus body;

a first sheet processing unit configured to process the sheet on which the image has been formed by the image forming portion;

a second sheet processing unit comprising a body separate from the first sheet processing unit and configured to be mounted between the first sheet discharge portion and the first sheet processing unit, the second sheet processing unit being configured to process the sheet discharged from the first sheet discharge portion and guide the sheet to the first sheet processing unit;

a first support portion provided on the first sheet processing unit;

a second support portion disposed upstream of the first support portion in a sheet discharge direction of the second sheet discharge portion and on or above the second sheet processing unit, the second support portion being configured to support stacked sheets, each of which is discharged out of the apparatus body by the second sheet discharge portion, in collaboration with the first support portion; and a trailing end regulating portion arranged on an upstream end of the second support portion in the sheet discharge direction and configured to be in contact with and regulate trailing ends, in the sheet discharge direction, of the sheets stacked on the first and second support portions.

2. The image forming apparatus according to claim 1, wherein the second support portion is supported by the first sheet processing unit.

3. The image forming apparatus according to claim 2, wherein the second support portion is movable between a first position and a second position with respect to the first sheet processing unit, the first position being a position which is on or above the second sheet processing unit mounted between the first sheet discharge portion and the first sheet processing unit and at which the second support portion projects upstream of the first support portion in the sheet discharge direction of the second sheet discharge portion, the second position being a position downstream of the first position in the sheet discharge direction.

4. The image forming apparatus according to claim 3, wherein the second support portion is configured to be drawn out from the first support portion and is moved from the second position to the first position by being drawn out upstream in the sheet discharge direction.

5. The image forming apparatus according to claim 3, wherein the first sheet processing unit is capable of being mounted at a first mount position, at which the first sheet processing unit receives the sheet discharged from the first sheet discharge portion via the second sheet processing unit, and a second mount position, at which the first sheet processing unit receives the sheet discharged from the first sheet discharge portion in a state where the second sheet processing unit is not mounted, and wherein, in a case where the first sheet processing unit is mounted at the second mount position, the second support portion is positioned at the second position.

6. The image forming apparatus according to claim 4, wherein the apparatus body comprises a wall surface on which the second support portion abuts in a case where the second sheet processing unit is mounted between the first sheet discharge portion and the first sheet processing unit and the second support portion is at the first position.

7. The image forming apparatus according to claim 2, wherein the first sheet processing unit is capable of being mounted at a first mount position, at which the first sheet processing unit receives the sheet discharged from the first sheet discharge portion via the second sheet processing unit, and a second mount position, at which the first sheet processing unit receives the sheet discharged from the first sheet discharge portion in a state where the second sheet processing unit is not mounted, and wherein the second support portion is supported together with the first support portion by the first sheet processing unit so as to be slidable and, in a case where the first sheet processing unit is mounted at the first mount position, the second support portion is slid to a more upstream position in the sheet discharge direction of the second sheet discharge portion than in a case where the first sheet processing unit is mounted at the second mount position.

8. The image forming apparatus according to claim 1, wherein the second support portion is provided on the second sheet processing unit.

9. The image forming apparatus according to claim 8, wherein a height of an upstream end of the first support portion in the sheet discharge direction of the second sheet discharge portion matches a height of a downstream end of the second support portion in the sheet discharge direction.

10. The image forming apparatus according to claim 1, further comprising a hold portion configured to hold the first sheet processing unit in such a manner that the first sheet processing unit is movable along the sheet discharge direction of the second sheet processing unit.

11. The image forming apparatus according to claim 1, wherein the first sheet processing unit is configured to perform a binding process of binding sheets together, and wherein the second sheet processing unit is configured to punch a sheet.

12. The image forming apparatus according to claim 1, wherein the first sheet processing unit is capable of being mounted at a first mount position, at which the first sheet processing unit receives the sheet discharged from the first sheet discharge portion via the second sheet processing unit, and a second mount position, at which the first sheet processing unit receives the sheet discharged from the first sheet discharge portion in a state where the second sheet processing unit is not mounted.

13. The image forming apparatus according to claim 1, further comprising a reading unit configured to read an image of a document, wherein the first sheet processing unit and the second sheet processing unit are mounted in a space between the image forming portion and the reading unit.

14. An image forming apparatus comprising:

an apparatus body;

an image forming portion disposed in the apparatus body and configured to form an image on a sheet;

a first sheet discharge portion configured to discharge the sheet, on which the image has been formed by the image forming portion, out of the apparatus body;

a second sheet discharge portion provided above the first sheet discharge portion and configured to discharge the sheet, on which the image has been formed by the image forming portion, out of the apparatus body;

a first sheet processing unit configured to process the sheet on which the image has been formed by the image forming portion;

a second sheet processing unit comprising a body separate from the first sheet processing unit and configured to be mounted between the first sheet discharge portion and the first sheet processing unit, the second sheet processing unit being configured to process the sheet discharged from the first sheet discharge portion and then guide the sheet to the first sheet processing unit;

a first support portion provided on the first sheet processing unit;

a second support portion disposed upstream of the first support portion in a sheet discharge direction of the second sheet discharge portion and configured in a body with the second sheet processing unit, the second support portion being configured to support stacked sheets, each of which is discharged out of the apparatus body by the second sheet discharge portion, in collaboration with the first support portion; and a trailing end regulating portion arranged on an upstream end of the second support portion in the sheet discharge direction and configured to be in contact with and regulate trailing ends, in the sheet discharge direction, of the sheets stacked on the first and second support portions.

15. The image forming apparatus according to claim 14, wherein a height of an upstream end of the first support portion in the sheet discharge direction of the second sheet discharge portion matches a height of a downstream end of the second support portion in the sheet discharge direction.

16. The image forming apparatus according to claim 14, further comprising a hold portion configured to hold the first sheet processing unit in such a manner that the first sheet processing unit is movable along the sheet discharge direction of the second sheet processing unit.

17. The image forming apparatus according to claim 14, wherein the first sheet processing unit is configured to perform a binding process of binding sheets together, and wherein the second sheet processing unit is configured to punch a sheet.

18. A sheet processing apparatus configured to be mounted on an image forming apparatus and process a sheet on which an image has been formed by the image forming apparatus, the image forming apparatus being provided with an apparatus body, an image forming portion disposed in the apparatus body and configured to form the image on the sheet, a first sheet discharge portion configured to discharge the sheet on which the image has been formed by the image forming portion, and a second sheet discharge portion provided above the first sheet discharge portion and configured to discharge the sheet on which the image has been formed by the image forming portion, the sheet processing apparatus comprising:

a receiving port configured to receive the sheet discharged out of the apparatus body by the first sheet discharge portion;

a processing portion configured to process the sheet received by the receiving port;

a discharge part which is provided on an opposite side to the receiving port and onto which the sheet processed by the processing portion is discharged; and a support portion provided above the receiving port and configured to support stacked sheets, each of which is discharged out of the apparatus body by the second sheet discharge portion, wherein the support portion is movable and is capable of being positioned at a position where a part of the support portion is located farther from the discharge part than the receiving port in a horizontal direction, and wherein the support portion is configured such that trailing ends, in a sheet discharge direction of the second sheet discharge portion, of the sheets stacked on the support portion are regulated by a trailing end regulating portion located on an upstream end in the sheet discharge direction with respect to the support portion.

19. The sheet processing apparatus according to claim 18, wherein the support portion is slidable with respect to the processing portion.

20. The sheet processing apparatus according to claim 19, wherein, in a state where a second sheet processing apparatus configured to receive and process the sheet discharged from the first sheet discharge portion is mounted on the image forming apparatus, the sheet processing apparatus is capable of being disposed at such a position that the receiving port receives the sheet conveyed from the second sheet processing apparatus.

21. The sheet processing apparatus according to claim 20, wherein the sheet processing apparatus is configured to perform a binding process of binding sheets together, and wherein the second sheet processing apparatus is configured to punch a sheet.

* * * * *